US007531749B2

(12) United States Patent
Archambeault et al.

(10) Patent No.: US 7,531,749 B2
(45) Date of Patent: May 12, 2009

(54) CABLE FOR HIGH SPEED DATA COMMUNICATIONS

(75) Inventors: Bruce R. Archambeault, Four Oaks, NC (US); Samuel R. Connor, Durham, NC (US); Daniel N. de Araujo, Cedar Park, TX (US); Joseph C. Diepenbrock, Raleigh, NC (US); Bhyrav M. Mutnury, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/761,822

(22) Filed: Jun. 12, 2007

(65) Prior Publication Data

US 2008/0308289 A1 Dec. 18, 2008

(51) Int. Cl.
*H01B 7/18* (2006.01)

(52) U.S. Cl. ..... 174/102 R; 174/108

(58) Field of Classification Search ..... 174/36, 174/110 R, 113 R, 102 R, 102 SP; 333/12
See application file for complete search history.

(56) References Cited

U.S. PATENT DOCUMENTS

| | | | | | |
|---|---|---|---|---|---|
| 2,254,068 | A * | 8/1941 | Frank | 439/111 |
| 2,290,698 | A * | 7/1942 | Mollerhoj | 174/13 |
| 2,294,919 | A * | 9/1942 | Lunsford | 174/120 SR |
| 2,338,299 | A * | 1/1944 | Rasmussen | 174/102 SP |
| 2,338,304 | A * | 1/1944 | Schmied | 174/102 SP |
| 2,391,037 | A * | 12/1945 | Shafer, Jr. | 174/102 SP |
| 2,998,840 | A * | 9/1961 | Davis | 428/189 |
| 3,603,715 | A | 9/1971 | Eilhardt et al. | |
| 4,336,420 | A | 6/1982 | Benz | |
| 4,873,393 | A * | 10/1989 | Friesen et al. | 174/34 |
| 5,142,100 | A * | 8/1992 | Vaupotic | 174/24 |
| 5,283,390 | A | 2/1994 | Hubis et al. | |
| 5,414,215 | A | 5/1995 | Dunand et al. | |
| 6,010,788 | A * | 1/2000 | Kebabjian et al. | 428/381 |
| 6,207,301 | B1 * | 3/2001 | Ohnishi et al. | 428/690 |
| 6,403,887 | B1 * | 6/2002 | Kebabjian et al. | 174/110 R |
| 6,677,518 | B2 | 1/2004 | Hirakawa et al. | |
| 6,686,537 | B1 | 2/2004 | Gareis et al. | |
| 6,815,611 | B1 * | 11/2004 | Gareis | 174/36 |
| 6,998,538 | B1 | 2/2006 | Fetterolf, Sr. et al. | |
| 7,358,436 | B2 * | 4/2008 | Dellagala et al. | 174/27 |

* cited by examiner

*Primary Examiner*—William H Mayo, III
(74) *Attorney, Agent, or Firm*—John Biggers; Cynthis G. Seal; Biggers & Ohanian LLP

(57) ABSTRACT

A cable for high speed data communications and method of manufacturing the cable, the cable including a first inner conductor enclosed by a first dielectric layer and a second inner conductor enclosed by a second dielectric layer, the inner conductors and the dielectric layers twisted in a rotational direction at a periodic rate along and about a longitudinal axis and conductive shield material wrapped in the rotational direction at the periodic rate along and about the longitudinal axis around the inner conductors and the dielectric layers, including overlapped wraps at the periodic rate along and about the longitudinal axis. Transmitting signals on the cable including transmitting a balanced signal characterized by a frequency in the range of 7-9 gigahertz on the cable.

18 Claims, 5 Drawing Sheets

CABLE FOR HIGH SPEED DATA COMMUNICATIONS

BACKGROUND OF THE INVENTION

1. Field of the Invention

The field of the invention is data processing, or, more specifically, cables for high speed data communications, methods for manufacturing such cables, and methods of transmitting signals on such cables.

2. Description of Related Art

High speed data communications over shielded cables are an important component to large high-end servers and digital communications systems. While optical cables provide long distance drive capability, copper cables are typically preferred in environments that require a shorter distance cable due to a significant cost savings opportunity. A typical copper cable used in environments requiring a shorter distance cable, is a twinaxial cable. A twinaxial cable is a coaxial cable that includes two insulated, inner conductors and a shield wrapped around the insulated inner conductors. Twinaxial cables are used for half-duplex, balanced transmission, high-speed data communications. In current art however, twinaxial cables used in data communications environments are limited in performance due to a bandstop effect.

For further explanation of typical twinaxial cables, therefore, FIG. 1 sets forth a perspective view of a typical twinaxial cable (100). The exemplary typical twinaxial cable (100) of FIG. 1 includes two conductors (106, 108) and two dielectrics (110, 112) surrounding the conductors. The conductors (106, 108) and the dielectrics (110, 112) are generally parallel to each other and a longitudinal axis (105). That is, the conductors (106, 108) and the dielectrics (110, 112) are not twisted about the longitudinal axis (105).

The typical twinaxial cable (100) of FIG. 1 also includes a shield (114). The shield, when wrapped around the conductors of a cable, acts as a Faraday cage to reduce electrical noise from affecting signals transmitted on the cable and to reduce electromagnetic radiation from the cable that may interfere with other electrical devices. The shield also minimizes capacitively coupled noise from other electrical sources, such as nearby cables carrying electrical signals. The shield (114) is wrapped around the conductors (106, 108). The shield (114) includes wraps (101-103) and about the longitudinal axis (105), each wrap overlapping the previous wrap. A wrap is a 360 degree turn of the shield around the longitudinal axis (105). The typical twinaxial cable of FIG. 1 includes three wraps (101-103), but readers of skill in the art will recognize that the shield may be wrapped around the inner conductors and the dielectric layers any number of times in dependence upon the length of the cable. Wrap (101) is shaded for purposes of explanation. Each wrap (101-103) overlaps the previous wrap. That is, wrap (101) is overlapped by wrap (102) and wrap (102) is overlapped by wrap (103). The overlap (104) created by the overlapped wraps is continuous along and about the longitudinal axis (105) of the cable (100).

The wraps (101-103) of the shield (114) create an overlap (104) of the shield that forms an electromagnetic bandgap structure ('EBG structure') that acts as the bandstop filter. An EBG structure is a periodic structure in which propagation of electromagnetic waves is not allowed within a stopband. A stopband is a range of frequencies in which a cable attenuates a signal. In the cable of FIG. 1, when the conductors (106, 108) carry current from a source to a load, part of the current is returned on the shield (114). The current on the shield (114) encounters the continuous overlap (104) of the shield (104) which creates in the current return path an impedance discontinuity—a discontinuity in the characteristic impedance of the cable. The impedance discontinuity in the current return path at the overlap (104) created by the wraps (101-103) acts as a bandstop filter that attenuates signals at frequencies in a stopband.

For further explanation, therefore, FIG. 2 sets forth a graph of the insertion loss of a typical twinaxial cable. Insertion loss is the signal loss in a cable that results from inserting the cable between a source and a load. The insertion loss depicted in the graph of FIG. 2 is the insertion loss of a typical twinaxial cable, such as the twinaxial cable described above with respect to FIG. 1. In the graph of FIG. 2, the signal (119) is attenuated (118) within a stopband (120) of frequencies (116) ranging from seven to nine gigahertz ('GHz'). The stopband (120) has a center frequency (121) that varies in dependence upon the composition of the shield, the width of the shield, and the rate that the shield is wrapped around the conductors and dielectrics. The center frequency (121) of FIG. 2 is 8 GHz.

The attenuation (118) of the signal (119) in FIG. 2 peaks at approximately −60 decibels ('dB') for signals with frequencies (116) in the range of approximately 8 GHz. The magnitude of the attenuation (118) of the signal (119) is dependent upon the length of the cable. The effect of the EBG structure, the attenuation of a signal, increases as the length of the EBG structure increases. A longer cable having a wrapped shield has a longer EBG structure and, therefore, a greater attenuation on a signal than a shorter cable having a shield wrapped at the same rate. That is, the longer the cable, the greater the attenuation of the signal.

Typical twinaxial cables for high speed data communications, therefore, have certain drawbacks. Typical twinaxial cables have a bandstop filter created by overlapped wraps of a shield that attenuates signals at frequencies in a stopband. The attenuation of the signal increases as the length of the cable increases. The attenuation limits data communications at frequencies in the stopband.

SUMMARY OF THE INVENTION

A cable for high speed data communications and methods for manufacturing such cable are disclosed, the cable including a first inner conductor enclosed by a first dielectric layer and a second inner conductor enclosed by a second dielectric layer, the inner conductors and the dielectric layers twisted in a rotational direction at a periodic rate along and about a longitudinal axis. The cable also including conductive shield material wrapped in the rotational direction at the periodic rate along and about the longitudinal axis around the inner conductors and the dielectric layers, the conductive shield material including overlapped wraps at the periodic rate along and about the longitudinal axis.

Methods of transmitting signals on for high speed data communications are also disclosed that include transmitting a balanced signal characterized by a frequency in the range of 7-9 gigahertz on a cable, the cable including a first inner conductor enclosed by a first dielectric layer and a second inner conductor enclosed by a second dielectric layer, the inner conductors and the dielectric layers twisted in a rotational direction at a periodic rate along and about a longitudinal axis. The cable also includes conductive shield material wrapped in the rotational direction at the periodic rate along and about the longitudinal axis around the inner conductors and the dielectric layers, the conductive shield material including overlapped wraps at the periodic rate along and about the longitudinal axis.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
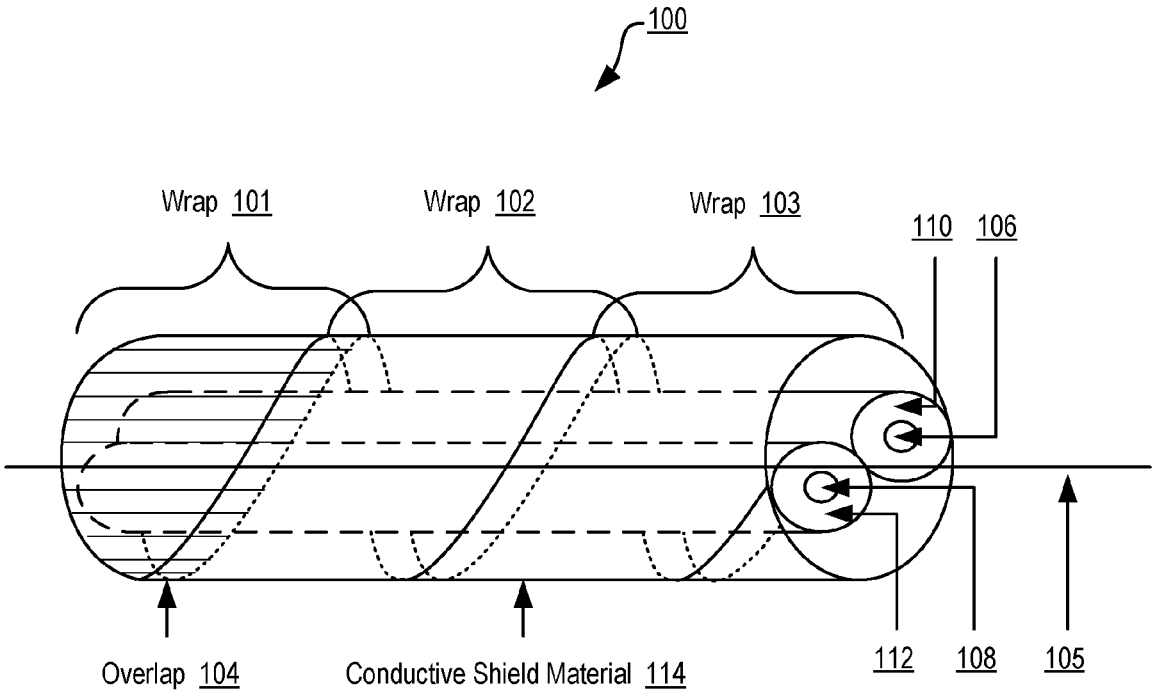
PRIOR ART FIG. 1
FIG. 1 sets forth a perspective view of a twinaxial cable.
Figure 2:
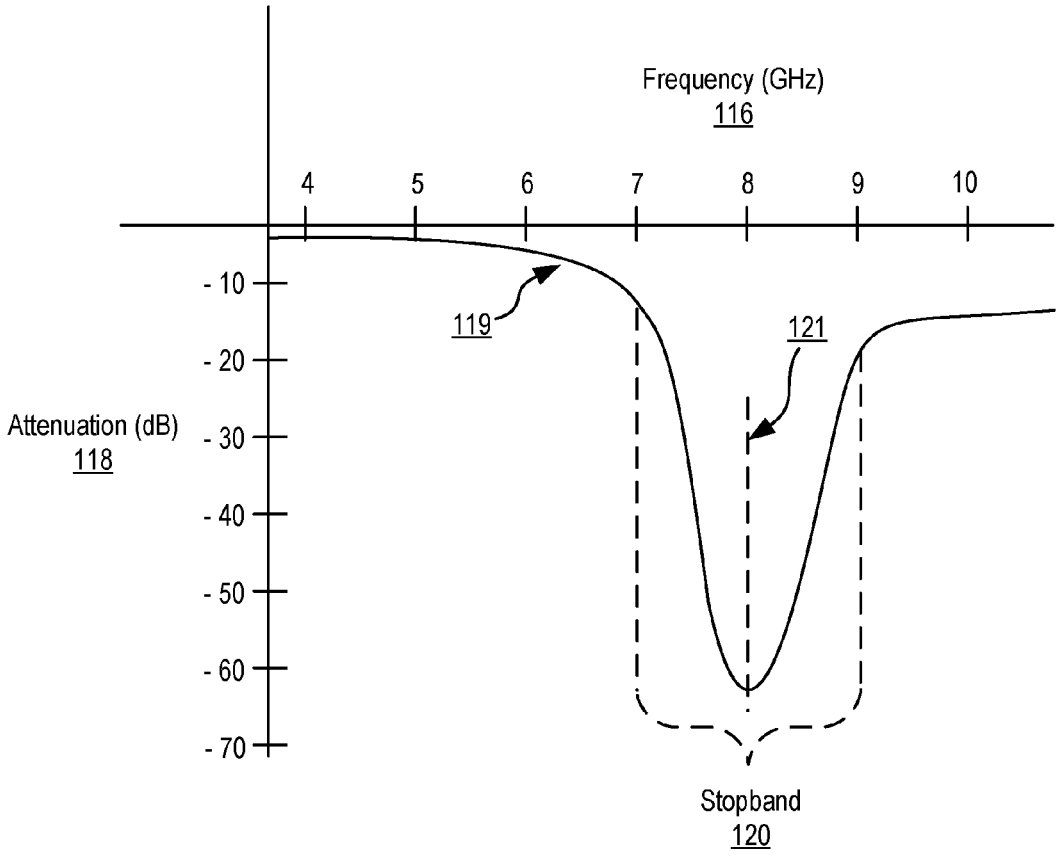
PRIOR ART FIG. 2
FIG. 2 sets forth a graph of the insertion loss of a typical twinaxial cable.
Figure 3:
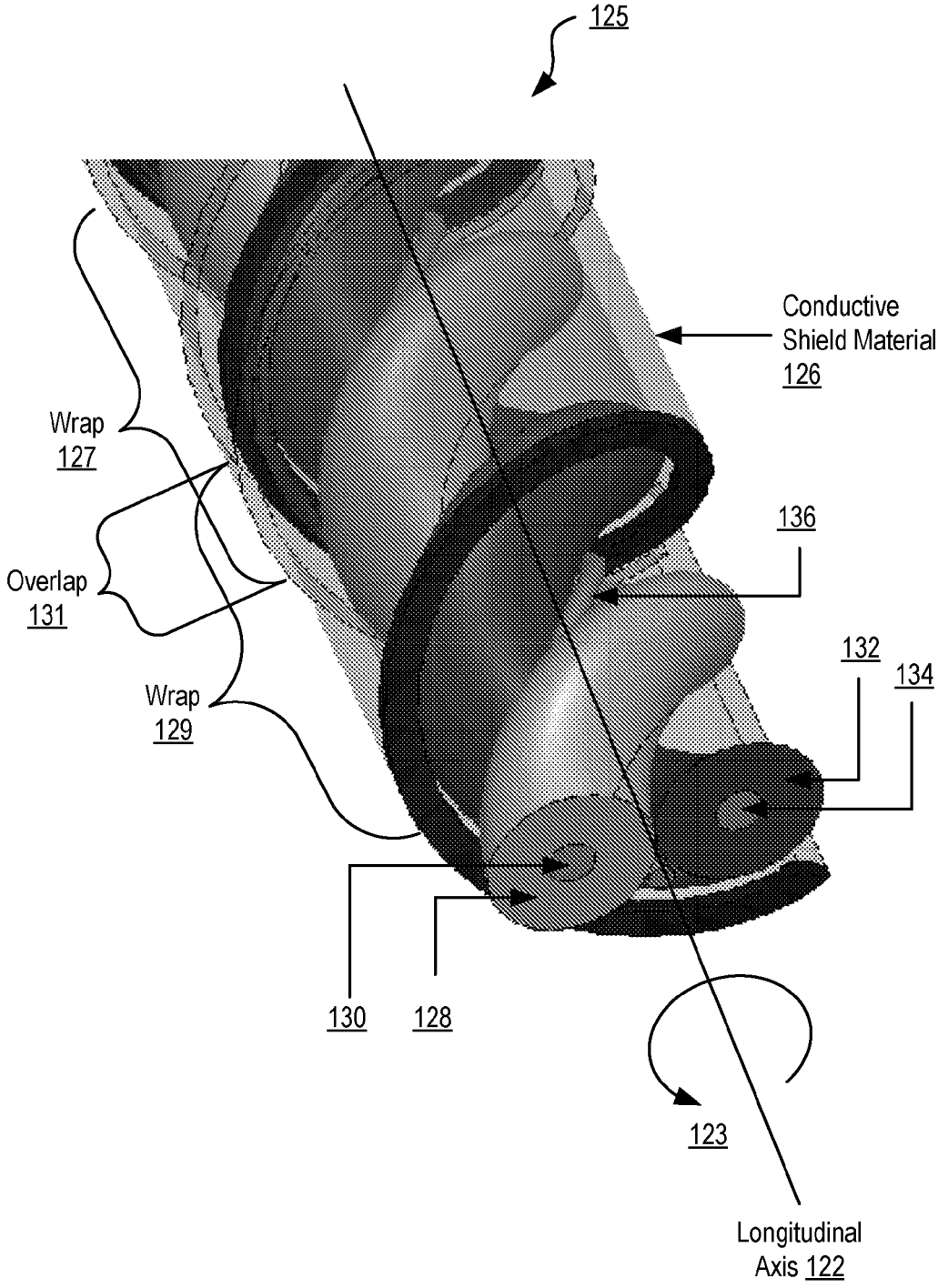
FIG. 3 sets forth a perspective view of a cable for high speed data communications according to embodiments of the present invention.

Exemplary cables for high speed data communications, methods for manufacturing such cables, and methods of transmitting signals on such cables according to embodiments of the present invention are described with reference to the accompanying drawings, beginning with FIG. 3. FIG. 3 sets forth a perspective view of a cable for high speed data communications according to embodiments of the present invention. The cable (125) of FIG. 3 includes a first inner conductor (134) enclosed by a first dielectric layer (132) and a second inner conductor (130) enclosed by a second dielectric layer (128). The inner conductors (134, 130) and the dielectric layers (132, 128) are twisted in a rotational direction (123) at a periodic rate along and about a longitudinal axis (122). The periodic rate is the number of turns of the inner conductors per unit of measure along the longitudinal axis. The periodic rate, for example, may be 3 turns per foot along a two foot cable or 20 turns per meter along a 15 meter cable. In the cable (125) of FIG. 3, the twisted inner conductors (134, 130) also include an optional drain conductor (136) twisted in the rotational direction (123) at a periodic rate about the longitudinal axis (122). A drain conductor is a non-insulated conductor electrically connected to the earth potential ('ground') and typically electrically connected to conductive shield material (126).

The cable (125) of FIG. 3 also includes conductive shield material (126) wrapped in the rotational direction (123) at the periodic rate, the same periodic rate as the twisted inner conductors, along and about the longitudinal axis (122) around the inner conductors (134, 130) and the dielectric layers (132, 128). The conductive shield material (126) includes overlapped wraps (127, 129) at the periodic rate along and about the longitudinal axis (122). In the cable of FIG. 3, the conductive shield material (126) is also wrapped around the drain conductor (136).

In the cable (125) of FIG. 3, the overlapped wraps (127, 129) of the conductive shield material (126) create a bandstop filter that attenuates signals at frequencies in a stopband. That is, when the inner conductors (134, 130) carry current from a current source to a load, a part of the current is returned on the conductive shield material (126). The current on the conductive shield material (126) encounters the continuous overlap (131) of the conductive shield material (126) which creates an impudence discontinuity in the current return path. The impedance discontinuity acts as a bandstop filter that attenuates signals at frequencies in a stopband. The stopband is characterized by a center frequency that is dependent upon the composition of the conductive shield material (126), the width of the conductive shield material (126), and the periodic rate of the wraps.

In the cable (125) of FIG. 3, however, the inner conductors (134, 130) twisted in a rotational direction at a periodic rate along and about a longitudinal axis and the conductive shield material (126) wrapped around the inner conductors (134, 130) and the dielectric layers (132, 128) in the rotational direction at the periodic rate along and about the longitudinal axis reduces the attenuation of signals having frequencies in the stopband. The inner conductors (134, 130) twisted in the same rotational direction and at the same periodicity as the conductive shield material (126), ensures that the cable has a uniform current return path. When the inner conductors (134, 130) are twisted in the same rotational direction as the conductive shield material (126), the return current of the conductors is always on the main width of the conductive shield material (126) and never on the overlap (131). The effect of the electromagnetic band gap structure, the attenuation of the signal, is therefore mitigated.

In the cable of FIG. 3, the conductive shield material (126) may be a strip of aluminum foil having a width that is relatively small with respect to the length of the cable. The width of strip of aluminum foil is relatively small with respect to the length of the cable, such that, when the strip of aluminum is wrapped around the inner conductors and the dielectric layers, at least one overlapped wrap is created. Although the conductive shield material (126) is described as a strip of aluminum foil, those of skill in the art will recognize that conductive shield material (126) may be any conductive material capable of being wrapped around the inner conductors of a cable, such as copper or gold. The cable (125) of FIG. 3 may also include a non-conductive layer that encloses the conductive shield material (126) and the twisted first and second inner conductors (134, 138). The non-conductive layer may be any insulating jacket useful in cables for high speed data communications as will occur to those of skill in the art.

Figure 4:
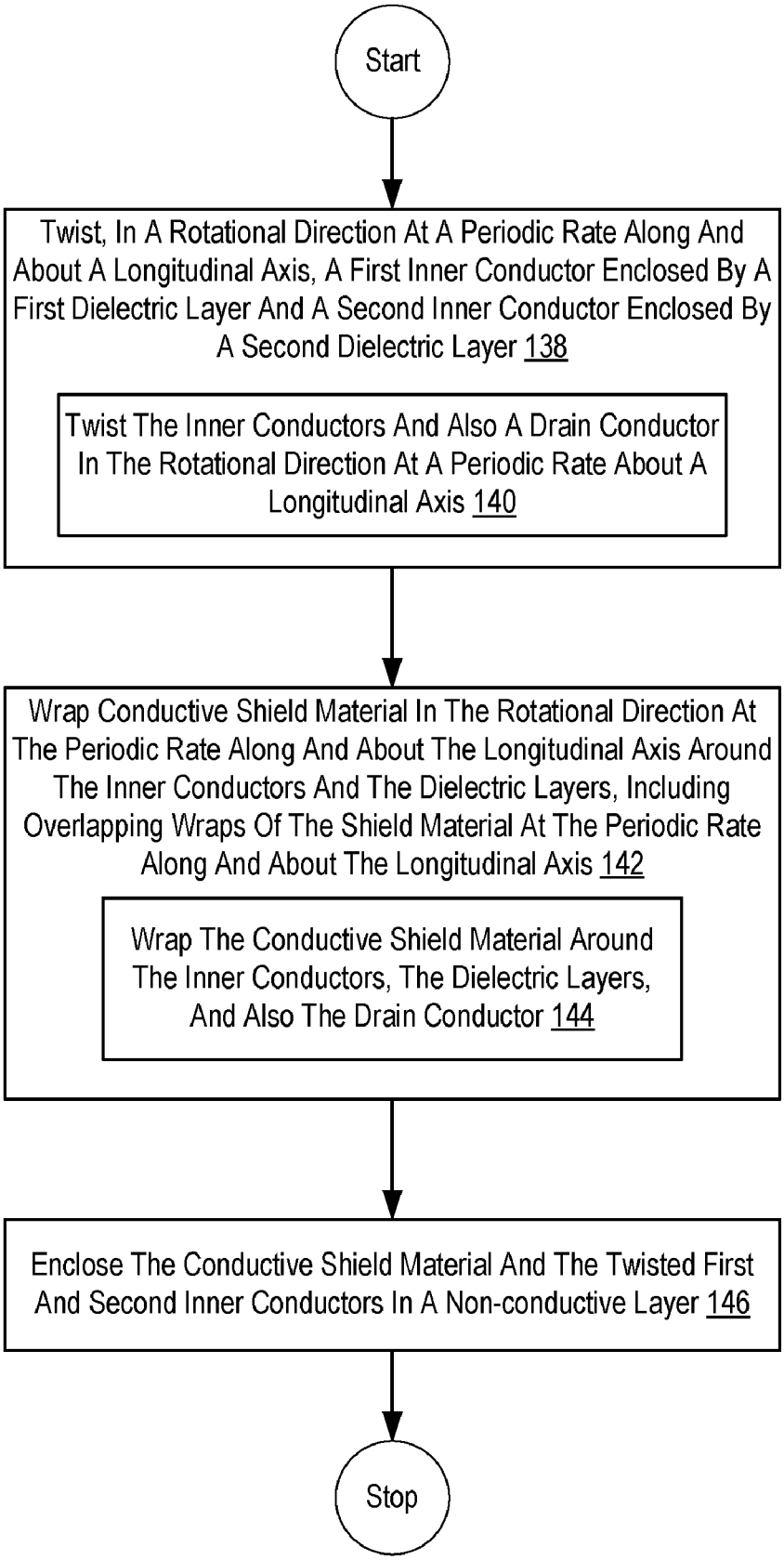
FIG. 4 sets forth a flow chart illustrating an exemplary method of manufacturing a cable for high speed data communications according to embodiments of the present invention.

For further explanation FIG. 4 sets forth a flow chart illustrating an exemplary method of manufacturing a cable for high speed data communications according to embodiments of the present invention. The method of FIG. 4 includes twisting (138), in a rotational direction at a periodic rate along and about a longitudinal axis, a first inner conductor enclosed by a first dielectric layer and a second inner conductor enclosed by a second dielectric layer.

The method of FIG. 4 also includes wrapping (142) conductive shield material in the rotational direction at the periodic rate, the same periodic rate as the twisted inner conductors, along and about the longitudinal axis around the inner conductors and the dielectric layers. Wrapping (142) conductive shield material includes overlapping wraps of the shield material at the periodic rate along and about the longitudinal axis. In the method of FIG. 4, the conductive shield material may be a strip of aluminum foil having a width that is relatively small with respect to the length of the cable.

In the method of FIG. 4, the overlapped wraps of the conductive shield material create a bandstop filter that attenuates signals at frequencies in a stopband. In the method of FIG. 4, the stopband is characterized by a center frequency that is dependent upon the composition of the conductive shield material, the width of the conductive shield material, and the periodic rate. In the method of FIG. 4, however, twisting (138) the inner conductors and wrapping (142) conductive shield material around the inner conductors and the dielectric layers in the rotational direction at the periodic rate reduces the attenuation of signals having frequencies in the stopband. In the method of FIG. 4, twisting (138) the inner conductors includes twisting (140) the inner conductors and also an optional drain conductor in the rotational direction at a periodic rate about the longitudinal axis. Also in the method of FIG. 4, wrapping (142) conductive shield material around the inner conductors and the dielectric layers includes wrapping (144) the conductive shield material around the inner conductors, the dielectric layers, and also the drain conductor. The method of FIG. 4 also includes enclosing (146) the conductive shield material and the twisted first and second inner conductors in a non-conductive layer.

Figure 5:
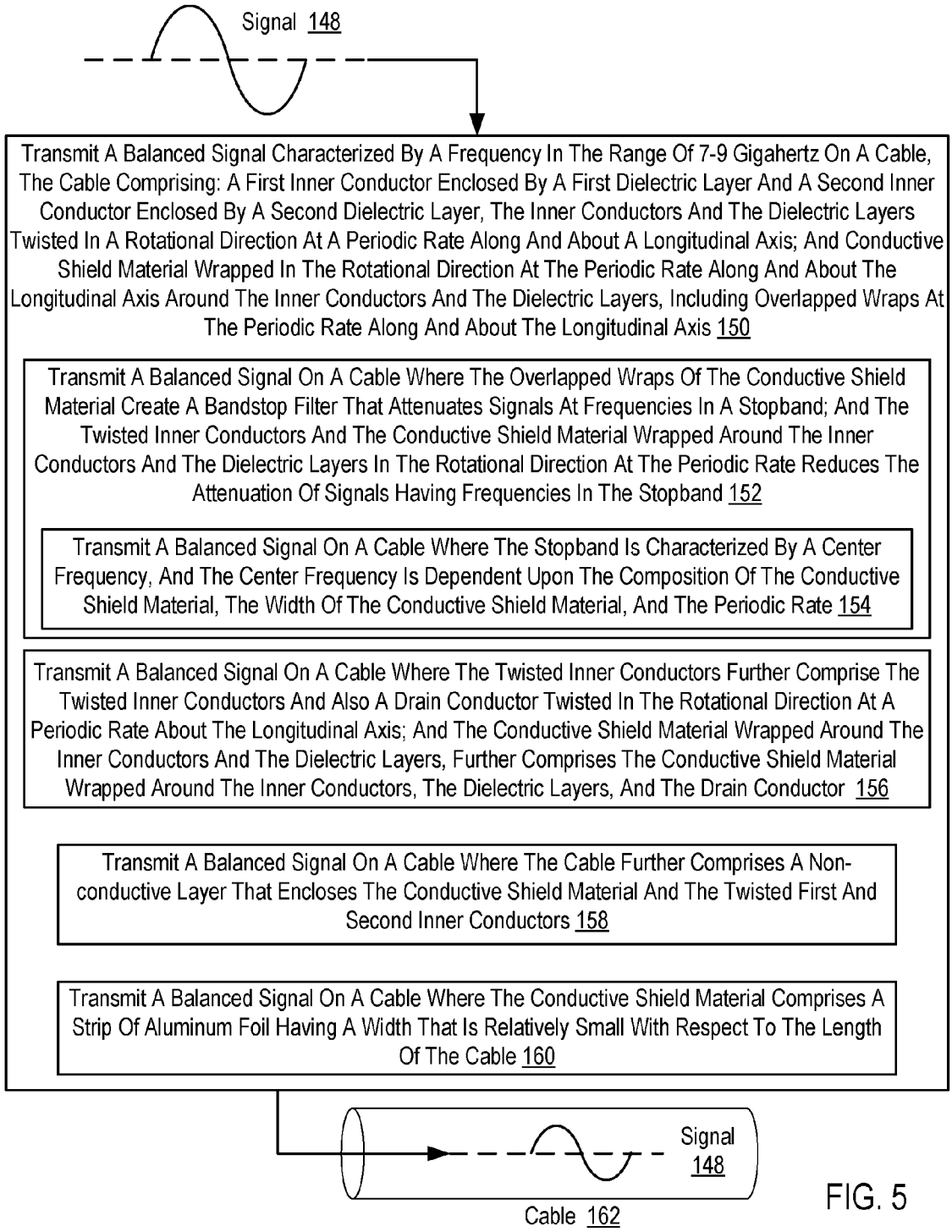
FIG. 5 sets forth a flow chart illustrating an exemplary method of transmitting a signal on a cable for high speed data communications according to embodiments of the present invention.

For further explanation FIG. 5 sets forth a flow chart illustrating an exemplary method of transmitting a signal on a cable (162) for high speed data communications according to embodiments of the present invention. The method of FIG. 5 includes transmitting (150) a balanced signal (148) characterized by a frequency in the range of 7-9 gigahertz on a cable (162). The cable (162) on which the signal (148) is transmitted includes a first inner conductor enclosed by a first dielectric layer and a second inner conductor enclosed by a second dielectric layer. The inner conductors and the dielectric layers are twisted in a rotational direction at a periodic rate along and about a longitudinal axis. The cable (148) also includes conductive shield material wrapped in the rotational direction at the periodic rate, the same periodic rate as the twisted inner conductors, along and about the longitudinal axis around the inner conductors and the dielectric layers. The conductive shield material includes overlapped wraps at the periodic rate along and about the longitudinal axis.

In method of FIG. 5 transmitting (150) a balanced signal on a cable includes transmitting (152) the balanced signal on the cable where the overlapped wraps of the conductive shield material create a bandstop filter that attenuates signals at frequencies in a stopband. In the method of FIG. 5, the twisted inner conductors and the conductive shield material wrapped around the inner conductors and the dielectric layers in the rotational direction at the periodic rate reduces the attenuation of signals having frequencies in the stopband.

In the method of FIG. 5, transmitting (152) the balanced signal on the cable includes transmitting (154) the balanced signal on the cable where the stopband is characterized by a center frequency, and the center frequency is dependent upon the composition of the conductive shield material, the width of the conductive shield material, and the periodic rate. In the method of FIG. 5, transmitting (150) a balanced signal on a cable also includes transmitting (158) the balanced signal on the cable where the conductive shield material comprises a strip of aluminum foil having a width that is relatively small with respect to the length of the cable.

In the method of FIG. 5, transmitting (150) a balanced signal on a cable also includes transmitting (156) the balanced signal on the cable where the twisted inner conductors include a drain conductor twisted in the rotational direction at a periodic rate about the longitudinal axis and the conductive shield material wrapped around the inner conductors and the dielectric layers, is also wrapped around the drain conductor. In the method of FIG. 5, transmitting (150) a balanced signal on a cable also includes transmitting (158) the balanced signal on the cable, where the cable includes a non-conductive layer that encloses the conductive shield material and the twisted first and second inner conductors.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A cable for high speed data communications, the cable comprising:

a first inner conductor enclosed by a first dielectric layer and a second inner conductor enclosed by a second dielectric layer, the inner conductors and the dielectric layers twisted in a rotational direction at a periodic rate along and about a longitudinal axis; and conductive shield material wrapped in the rotational direction at the periodic rate along and about the longitudinal axis around the inner conductors and the dielectric layers, including overlapped wraps at the periodic rate along and about the longitudinal axis.

2. The cable of claim 1 wherein:

the overlapped wraps of the conductive shield material create a bandstop filter that attenuates signals at frequencies in a stopband; and the twisted inner conductors and the conductive shield material wrapped around the inner conductors and the dielectric layers in the rotational direction at the periodic rate reduces the attenuation of signals having frequencies in the stopband.

3. The cable of claim 2 wherein the stopband is characterized by a center frequency, and the center frequency is dependent upon the composition of the conductive shield material, the width of the conductive shield material, and the periodic rate.

4. The cable of claim 1 wherein:

the twisted inner conductors further comprise the twisted inner conductors and also a drain conductor twisted in the rotational direction at a periodic rate about the longitudinal axis; and the conductive shield material wrapped around the inner conductors and the dielectric layers, further comprises the conductive shield material wrapped around the inner conductors, the dielectric layers, and the drain conductor.

5. The cable of claim 1 further comprising:

a non-conductive layer that encloses the conductive shield material and the twisted first and second inner conductors.

6. The cable of claim 1 wherein the conductive shield material comprises a strip of aluminum foil having a width that is relatively small with respect to the length of the cable.

7. A method of manufacturing a cable for high speed data communications, the method comprising:

twisting, in a rotational direction at a periodic rate along and about a longitudinal axis, a first inner conductor enclosed by a first dielectric layer and a second inner conductor enclosed by a second dielectric layer; and wrapping conductive shield material in the rotational direction at the periodic rate along and about the longitudinal axis around the inner conductors and the dielectric layers, including overlapping wraps of the shield material at the periodic rate along and about the longitudinal axis.

8. The method of claim 7 wherein:

the overlapped wraps of the conductive shield material create a bandstop filter that attenuates signals at frequencies in a stopband; and twisting the inner conductors and wrapping conductive shield material around the inner conductors and the dielectric layers in the rotational direction at the periodic rate reduces the attenuation of signals having frequencies in the stopband.

9. The method of claim 8 wherein the stopband is characterized by a center frequency, and the center frequency is dependent upon the composition of the conductive shield material, the width of the conductive shield material, and the periodic rate.

10. The method of claim 7 wherein:

twisting the inner conductors further comprises twisting the inner conductors and also a drain conductor in the rotational direction at a periodic rate about the longitudinal axis; and wrapping conductive shield material around the inner conductors and the dielectric layers further comprises wrapping the conductive shield material around the inner conductors, the dielectric layers, and also the drain conductor.

11. The method of claim 7 further comprising:

enclosing the conductive shield material and the twisted first and second inner conductors in a non-conductive layer.

12. The method of claim 7 wherein the conductive shield material comprises a strip of aluminum foil having a width that is relatively small with respect to the length of the cable.

13. A method of transmitting a signal on a cable for high speed data communications, the method comprising:

transmitting a balanced signal characterized by a frequency in the range of 7-9 gigahertz on a cable, the cable comprising:

a first inner conductor enclosed by a first dielectric layer and a second inner conductor enclosed by a second dielectric layer, the inner conductors and the dielectric layers twisted in a rotational direction at a periodic rate along and about a longitudinal axis; and conductive shield material wrapped in the rotational direction at the periodic rate along and about the longitudinal axis around the inner conductors and the dielectric layers, including overlapped wraps at the periodic rate along and about the longitudinal axis.

14. The method of claim 13 wherein:

the overlapped wraps of the conductive shield material create a bandstop filter that attenuates signals at frequencies in a stopband; and the twisted inner conductors and the conductive shield material wrapped around the inner conductors and the dielectric layers in the rotational direction at the periodic rate reduces the attenuation of signals having frequencies in the stopband.

15. The method of claim 14 wherein the stopband is characterized by a center frequency, and the center frequency is dependent upon the composition of the conductive shield material, the width of the conductive shield material, and the periodic rate.

16. The method of claim 13 wherein:

the twisted inner conductors further comprise the twisted inner conductors and also a drain conductor twisted in the rotational direction at a periodic rate about the longitudinal axis; and the conductive shield material wrapped around the inner conductors and the dielectric layers, further comprises the conductive shield material wrapped around the inner conductors, the dielectric layers, and the drain conductor.

17. The method of claim 13 wherein the cable further comprises a non-conductive layer that encloses the conductive shield material and the twisted first and second inner conductors.

18. The method of claim 13 wherein the conductive shield material comprises a strip of aluminum foil having a width that is relatively small with respect to the length of the cable.

* * * * *